United States Patent [19]

Cormack

[11] Patent Number: 4,779,370

[45] Date of Patent: Oct. 25, 1988

[54] FIREARM WITH REMOVABLE BARREL AND TELESCOPIC SIGHT

[75] Inventor: Alexander J. R. Cormack, Wallingford, Conn.

[73] Assignee: O.F. Mossberg & Sons, Inc., North Haven, Conn.

[21] Appl. No.: 89,963

[22] Filed: Aug. 26, 1987

[51] Int. Cl.[4] ..... F41G 1/10; F41G 1/38

[52] U.S. Cl. ..... 42/100; 42/101; 42/75.02; 33/245; 33/254

[58] Field of Search ..... 42/101, 8, 40, 63, 77, 42/75.02, 100; 33/245, 261, 246, 247, 248, 249, 250, 254

[56] References Cited

U.S. PATENT DOCUMENTS

| | | | |
|---|---|---|---|
| 194,489 | 8/1877 | Wallis | 42/77 |
| 708,078 | 9/1902 | Robertson | 42/63 |
| 2,632,251 | 3/1953 | Weaver | 42/101 |
| 2,763,930 | 9/1956 | Ivy | 33/245 |
| 2,825,138 | 3/1958 | Ivy | 33/245 |
| 4,125,054 | 11/1978 | Jennie | 42/75.02 |
| 4,208,821 | 6/1980 | Power | 42/100 |
| 4,341,022 | 7/1982 | Santoro | 42/101 |
| 4,606,131 | 8/1986 | Domian | 42/100 |

FOREIGN PATENT DOCUMENTS

| | | | |
|---|---|---|---|
| 1083762 | 9/1967 | United Kingdom | 42/75.02 |

*Primary Examiner*—Charles T. Jordan
*Assistant Examiner*—Michael J. Carone
*Attorney, Agent, or Firm*—McCormick, Paulding & Huber

[57] ABSTRACT

A firearm having a receiver and a changeable barrel releasably connected to the receiver. A sight mounting member integrally connected to the barrel forward of the receiver extends for some distance in a rearward direction above the receiver and carries a telescopic sight. The barrel, sight mounting member and telescopic sight are removable from and assembled with the receiver as a unit. The sight mounting member also carries an adjustable open rear sight which cooperates with a front sight mounted in fixed position at the forward end of the barrel.

8 Claims, 2 Drawing Sheets

FIREARM WITH REMOVABLE BARREL AND TELESCOPIC SIGHT

BACKGROUND OF THE INVENTION

This invention relates in general to firearms and deals more particularly with a shotgun and other firearm having interchangeable barrels and a telescopic sight for use with at least one of the barrels. A shotgun of the type with which the present invention is concerned is used and has a barrel for firing a slug and a telescopic sight for use with the slug barrel. The gun may also be provided other separate barrels particularly adapted for other types of shooting, such as trap shooting, skeet shooting and grouse hunting. As is customary, the telescopic sight used with the slug barrel is mounted on the receiver and is removed from the gun when the gun is used for another type of shooting. After a barrel change has been made, the telescopic sight must be "sighted-in" to assure accuracy; a time consuming task.

Accordingly, it is the general aim of the present invention to provide a firearm having a removable barrel and a telescopic sight and wherein is unnecessary to "sight-in" the telescopic sight after a barrel change.

SUMMARY OF THE INVENTION

In accordance with the present invention, an improved firearm has a receiver, a barrel releasably connected to the receiver, and a sight mounting member secured in fixed position to the barrel forward of the receiver and extending in a rearward direction for some distance above the receiver for carrying a telescopic sight. The barrel and the sight mounting member with the telescopic sight attached thereto is removable from or assembled with the receiver as a unit.

DETAILED DESCRIPTION OF PREFERRED EMBODIMENT

Figure 1:
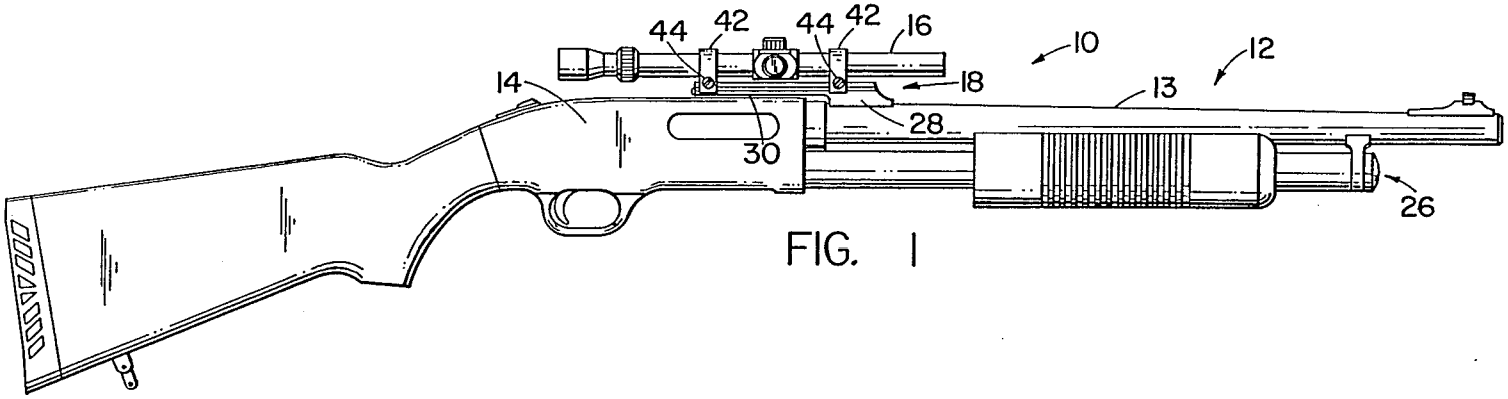
FIG. 1 is a side elevational view of a firearm equiped with a telescopic sight and embodying the present invention.
Figure 2:
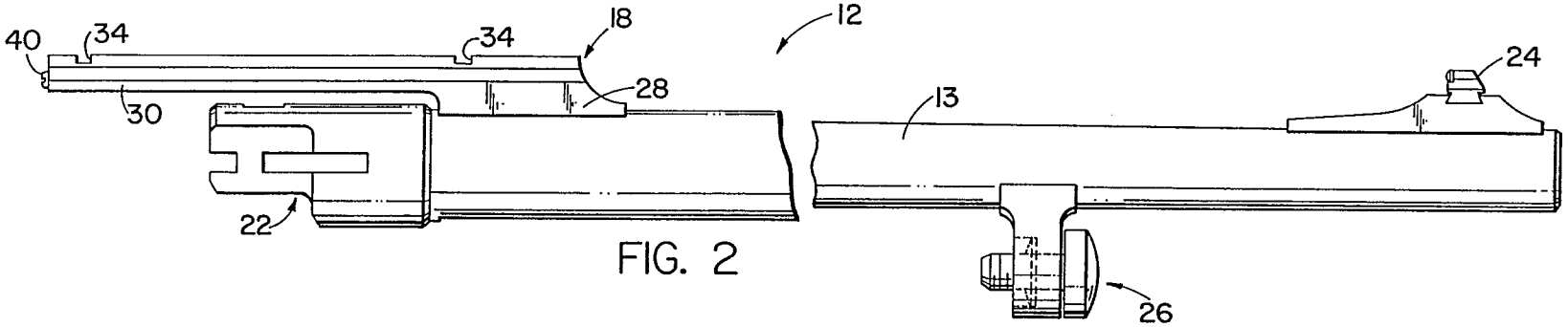
FIG. 2 is a somewhat enlarged fragmentary side elevational view of the barrel and sight mounting member of FIG. 1.
Figure 4:
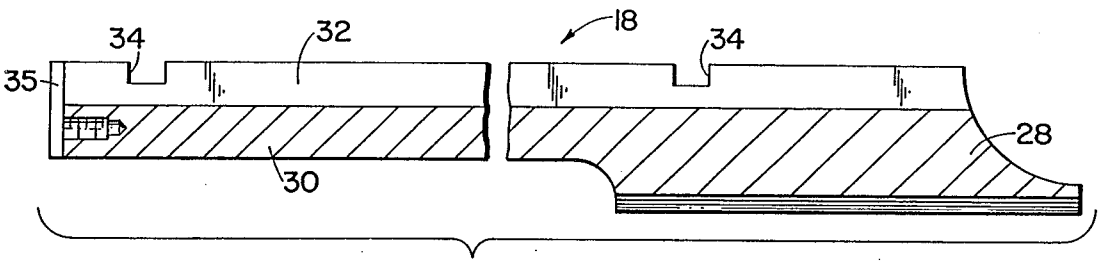
FIG. 4 is a somewhat further enlarged fragmentary longitudinal sectional view through the sight mounting member.

Referring now to the drawings, a firearm having a telescopic sight and embodying the present invention is shown in FIG. 1 and indicated generally by the reference numeral 10. The illustrated firearm 10 is a shotgun of the type having readily interchangeable barrels for altering the shooting characteristics of the gun. Such a gun may, for example, be readily adapted for hunting waterfowl or deer and other big game by simply attaching an appropriate barrel. The illustrated gun is a Turkey/Deer Combo Model 500 shotgun manufactured and marketed by O. F. Mossberg & Sons, Inc., 7 Grasso Avenue, North Haven, Conn. 06473, and is shown in FIG. 1 with a barrel assembly indicated generally at 12 mounted thereon. The barrel assembly 12 includes a barrel 13 which particularly adapts the gun for hunting deer and other large game. The gun 10 further includes a receiver 14 and a telescopic sight or scope 16 carried by a sight mounting member, indicated generally at 18, which is secured in fixed position to the barrel 13 and comprises an integral part of the barrel assembly 12. The barrel assembly 12 and scope 16 may be removed from or assembled with the firearm receiver 14 as a unit, all of which will be hereinafter more fully explained.

Considering now the firearm 10 in further detail the cylindrical barrel 13 has a bore 20 which extends coaxially through it and a locking portion at its breech end, indicated generally at 22. The locking portion has locking recesses for engaging associated locking lugs (not shown) contained within the forward end of the receiver 14 to releasably retain the barrel in assembly with the receiver. At its forward end the barrel carries a fixed front sight 24. A conventional take-down mount and screw assembly, indicated generally at 26, is attached to and depends from the lower surface of the barrel 13 for further securing the barrel in its assembled position relative to the receiver 14, in a manner well known in the art.

In accordance with the present invention the sight mounting member 18 is integrally secured to the barrel 13 by silver solder or otherwise suitably secured in fixed position to the barrel immediately forward of the receiver 14 and comprises an integral part of the barrel assembly. The illustrated sight mounting member or scope adapter 18 comprises a generally L-shaped member having a downwardly extending mounting portion 28 at its forward end secured to the barrel and a sight or scope supporting portion 30 which extends for some distance in a rearward direction above the receiver 14 as shown in FIG. 1. The sight supporting portion 30 is not connected to the receiver, but is spaced above the receiver a sufficient distance to provide adequate clearance between the upper surface of the receiver and the lower surface of the scope mounting portion to allow assembly of the barrel 13 with and removal of the barrel from the receiver 14 without risk of damage to or deformation of the scope mounting portion 30.

Figure 8:
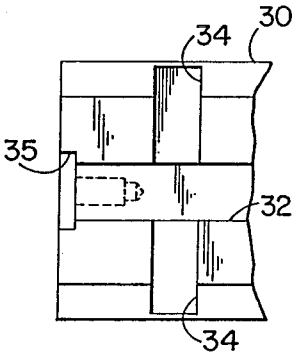
FIG. 8 is a fragmentary plan view of the rear portion of the sight mounting member.
Figure 10:
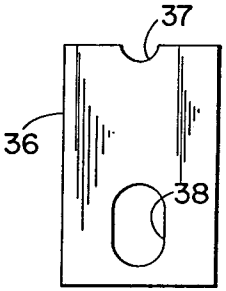
FIG. 10 is a somewhat enlarged rear elevational view of the rear sight blade.
Figure 6:
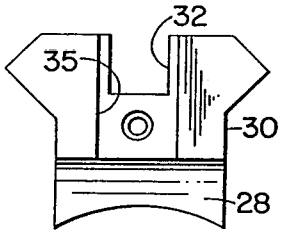
FIG. 6 is a rear elevational view of the sight mounting member.
Figure 7:
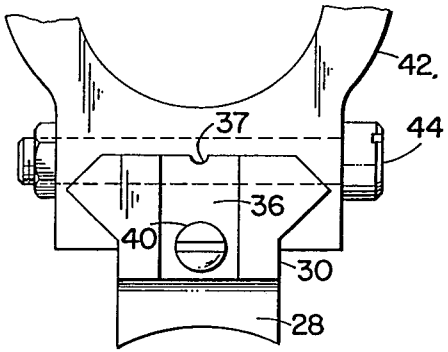
FIG. 7 is similar to FIG. 6 but shows the rear sight blade and a scope mounting ring attached to the sight mounting member.
Figure 3:
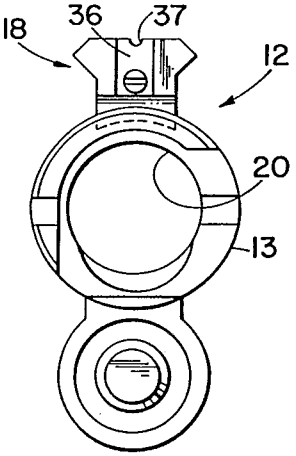
FIG. 3 is a rear elevational view of the barrel and sight mounting member shown in FIG. 2.
Figure 5:
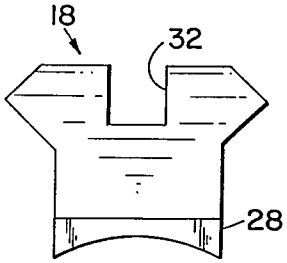
FIG. 5 is a front elevational view of the sight mounting member.

The sight supporting portion 30 has a uniform dovetailed cross-sectional configuration throughout its length. An upperwardly open sighting groove 32 extends longitudinally through the sight mounting member 18 in substantially parallel relation to the axis of the bore 20. The cross sectional configuration of the sighting groove may vary, however, in the presently preferred embodiment of the invention the sighting groove 32 has a substantially uniform rectangular cross-section throughout its entire length, as best shown in FIGS. 5 and 8. Longitudinally spaced apart and upwardly open generally rectangular notche 34,34 are formed in the upper portion of the sight mounting member 18, substantially as shown.

Figure 9:
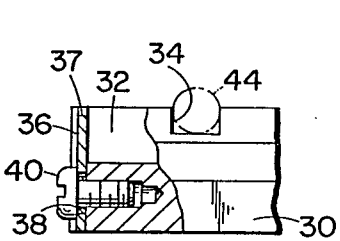
FIG. 9 is a fragmentary side elevational view of the sight mounting member with the rear sight blade attached and shown partially in longitudinal section.

A vertically disposed rearwardly open slot 35 in the rear end of the sight supporting portion 30 receives a complementary elevation plate or rear sight blade 36. The sight blade has a sighting notch 37 at its upper end and an adjustment slot 38 for receiving a retaining fastener 40 which theadably engages the sight mounting member 18, substantially as shown in FIG. 9.

The scope used in practicing the invention is of conventional type having and includes clamping rings 42,42 having dove-tailed clamping portions which substantially complement the dove-tailed configuration of the sight supporting portion 30. Clamping screws 44,44 secure the scope to the sight mounting member and pass through the notches 34,34, which enable a low profile to be maintained. The clamping screws 44,44 also cooperate with the notches 34,34 to prevent rearward movement of the scope 16 relative to the scope mounting member 18 due to recoil.

It will now be apparent that when a scope, such as the scope 16, is attached to the sight mounting member 18 and properly "sighted in", the barrel, sight mounting member 18 and scope may be removed from the firearm as a unit to permit another type of barrel to be used and may be reassembled with the firearm at some later time without necessity for further scope adjustment. If the scope is removed from the sight mounting member, the open sights, once adjusted, may be used without requirement for further adjustment.

Figure 12:
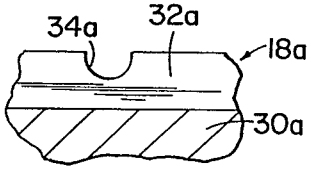
FIG. 12 is a fragmentary longitudinal sectional view similar to FIG. 4, but shows another sight mounting member.
Figure 11:
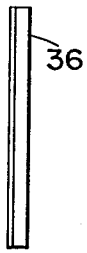
FIG. 11 is a side elevational view of the rear sight blade.

In FIG. 12 there is shown another sight mounting member embodying the invention and indicated at **18*a*. The mounting member 18*a* differs from the mounting member 18, previously described, only in the shape of the notches 34*a*, 34*a* (one shown). Specifically the notches 34*a*, 34*a*** each have a parti-cylindrical cross section to substantially compliment the scope clamping screws which pass through the notches

I claim:

1. In a firearm having a receiver, a barrel having a bore therethrough, a front sight mounted in fixed position on the barrel, means for releasably securing the barrel to the receiver, and mounting means for supporting a telescopic sight in fixed sighting position on the firearm, the improvement wherein said mounting means comprises a sight mounting member secured in fixed position to the barrel forward of the receiver and having a sight supporting protion extending for some distance in a rearward direction above and in closely spaced relation to the receiver, said sight mounting member having a rearwardly open guide slot therein, and a rear sight blade slidably supported in said guide slot for vertical adjustment to said sight mounting member and generally toward and away from said receiver to cooperate in sighting relation to the front sight, a telescopic sight secured in fixed position to said sight supporting portion being removable from the receiver with said barrel.

2. In a firearm as set forth in claim 1, the further improvement wherein said sight mounting member includes an upwardly open sighting groove formed in and extending through said sight supporting portion in generally parallel relation to the bore.

3. In a firearm as set forth in claim 2, the further improvement wherein said rear sight blade mounted on said sight mounting member at the rear of said sighting groove.

4. In a firearm as set forth in claim 1 the further improvement wherein said sight blade has a vertically elongated adjustment slot therethrough and a fastener extending through said adjustment slot and threadably engaged in said sight mounting member.

5. In a firearm having a receiver, a barrel having a bore therethrough, and a front sight mounted in fixed position thereon cooperating means on the barrel and the receiver for releasably securing the barrel to the receiver, a telescopic sight, and mounting means for releasably securing the telescopic sight to the firearm, the improvement comprising said mounting means including a generally L-shaped mounting member having a downwardly extending mounting portion at its forward end integrally secured to the barrel forward of the receiver and a sight supporting portion extending for some distance rearwardly from said mounting portion and above and in closely spaced relation to the receiver, said sight supporting portion having an upwardly open sighting groove extending longitudinally therethrough in generally parallel relation to the bore, said sight supporting portion having a vertically extending rearwardly open guide slot in the rear end thereof; a vertically adjustable rear sight blade received within said guide slot and having a vertically extending adjustment slot therethrough, and a fastener extending through said adjustemnt slot and threadably engaged in said sight supporting portion, the barrel and said mounting member with the telescopic sight attached thereto being separable as a unit from the receiver.

6. In a firearm as set forth in claim 5 the further improvement wherein said sight supporting portion has longitudinally spaced apart and upwardly open slots extending transversely thereof and the said mounting means includes clamping screws associated with the telescopic sight and extending through said slots.

7. In a firearm as set forth in claim 6 the further improvement wherein said sight supporting portion has a substantially uniform dove-tailed cross sectional configuration throughout its length and the telescopic sight includes clamping members which at least partially compliment said dove-tailed cross sectional configuration.

8. The combination comprising a firearm barrel having a bore therethrough, means for releasably securing said firearm barrel to the receiver of an associated firearm, a front sight mounted in fixed position on said barrel, a telescopic sight mounting member secured in fixed position on the upper surface of said barrel and having a telescopic sight mounting portion extending for some distance in a rearward direction beyond the rear end of said barrel for supporting a telescopic sight in fixed position thereon, said sight mounting member having a rearwardly open guide slot therein, and a rear sight blade supported in said guide slot for vertical adjustment relative to said telescopic sight mounting member and generally toward and away from the axis of said bore to cooperate in sighting relation to said front sight.

* * * * *